United States Patent [19]

Kirkland

[11] 4,284,142

[45] Aug. 18, 1981

[54] METHOD AND APPARATUS FOR REMOTE INSTALLATION AND SERVICING OF UNDERWATER WELL APPARATUS

[75] Inventor: Kerry G. Kirkland, Houston, Tex.

[73] Assignee: Armco Inc., Middletown, Ohio

[21] Appl. No.: 36,658

[22] Filed: May 7, 1979

[51] Int. Cl.[3] ..... E21B 17/02; E21B 23/00; E21B 33/035

[52] U.S. Cl. ..... 166/344; 166/85; 166/313; 166/315; 166/362

[58] Field of Search ..... 166/315, 313, 344, 345, 166/348, 351, 359, 362, 85, 88

[56] References Cited

U.S. PATENT DOCUMENTS

| | | | |
|---|---|---|---|
| 2,808,229 | 10/1957 | Bauer et al. | 166/88 |
| 3,228,715 | 1/1966 | Neilon et al. | 285/317 |
| 3,268,241 | 8/1966 | Castor et al. | 285/139 |
| 3,368,618 | 2/1968 | Knox | 166/344 |
| 3,540,533 | 11/1970 | Morrill | 166/344 |
| 3,661,206 | 5/1972 | Putch et al. | 166/89 |
| 3,688,841 | 9/1972 | Baugh | 166/85 |
| 3,741,294 | 6/1973 | Morrill | 166/89 |
| 4,003,434 | 1/1977 | Garrett et al. | 166/315 |
| 4,077,472 | 3/1978 | Gano | 166/315 |
| 4,116,272 | 9/1978 | Barrington | 166/340 |

*Primary Examiner*—James A. Leppink

*Attorney, Agent, or Firm*—Roylance, Abrams, Berdo & Farley

[57] ABSTRACT

Method and apparatus for remote installation and retrieval of underwater well apparatus and servicing of underwater wells without diver assistance by use of a remotely operated tool carried by a handling string including a composite lower joint which contains both smaller flow passages for conveying pressure fluid to the tool and larger passages for communicating with pipe in the well, the composite joint being of sufficient length to extend completely through the blowout preventers when the tool is in operative position and having a right cylindrical outer surface against which the blowout preventers can seal regardless of the rotational position of the composite joint. The invention is especially useful in connection with wells having multiple strings of tubing.

16 Claims, 25 Drawing Figures

FIG. 5
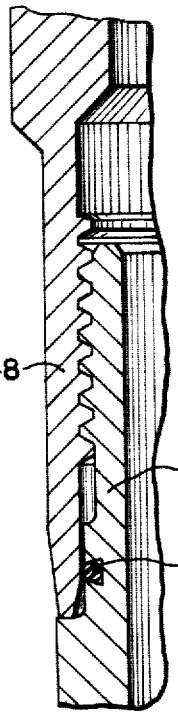
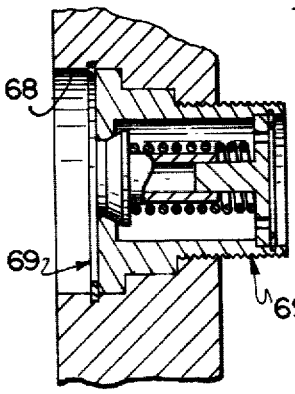
FIG. 6
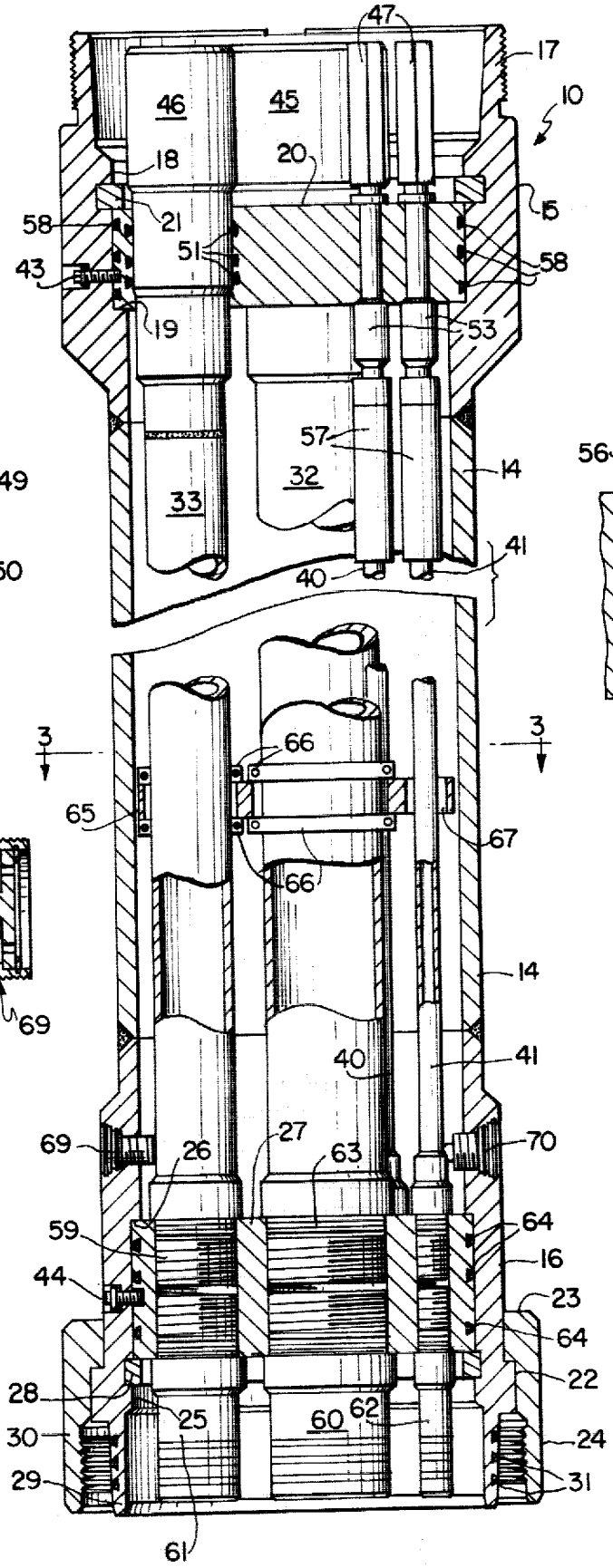
FIG. 2
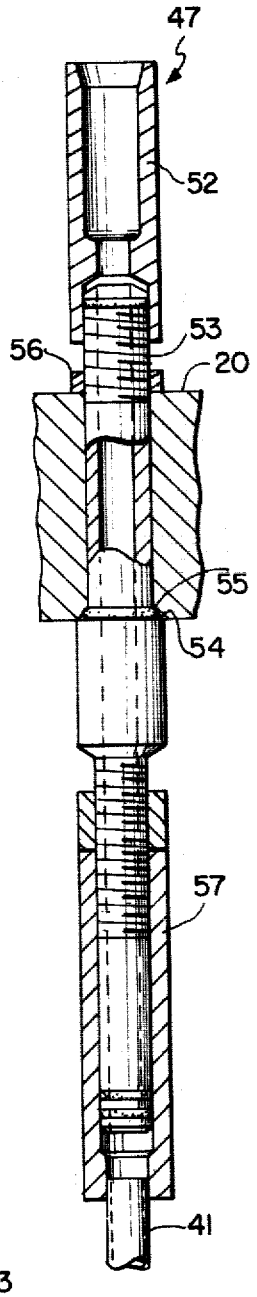
FIG. 4

METHOD AND APPARATUS FOR REMOTE INSTALLATION AND SERVICING OF UNDERWATER WELL APPARATUS

RELATED APPLICATIONS

Subject matter disclosed herein is disclosed and claimed in copending applications Ser. Nos. 36,660 and 36,659, filed concurrently herewith by Michael L. Wilson.

BACKGROUND OF THE INVENTION

It is conventional to establish oil and gas wells in underwater fields, with the well being drilled from a vessel, platform or other operational base at the surface of the body of water. When the wells have been drilled in relatively shallow water, it has been possible to install equipment, including equipment at the wellhead, with the assistance of divers, but increasing water depths and other factors have caused prior-art workers to develop methods and apparatus which accomplish all of the necessary tasks remotely from the operational base at the surface, without depending on diver assistance.

One of the tasks involved in establishing an underwater well is the installation, operation and retrieval of well tools such as tubing hangers, casing hangers, pack-off or seal devices, and the like. Other typical tasks include carrying out work-over operations, to service the well. Much work in these areas has been done and it has become common practice to install underwater well components or tools with a handling string, usually in the form of a string of drill pipe, as shown for example in U.S. Pat. No. 4,003,434, issued Jan. 18, 1977, to Garrett et al. Such methods and apparatus have also been applied to multiple string well installations, as seen for example in U.S. Pat. Nos. 3,661,206, issued May 9, 1972, to Putch et al, and 3,741,294, issued June 26, 1973, to Morrill. While such prior-art efforts have achieved considerable success in the field, there has been a continuing need both for overall improvement and for methods and apparatus which will solve a number of common problems as yet not satisfactorily met. One such problem arises first from the need to maintain communication with well pipes, typically multiple tubing strings, during such operations as landing of a tubing hanger, while providing adequately for blowout protection. That problem becomes more complicated as the water depth increases since, to provide adequate blowout protection conventionally, it is necessary that the tubing strings be positively positioned relative to the blowout preventor, and precise positioning is difficult if not impossible to achieve from the surface by prior-art practices when the strings of pipe extending from the surface to the wellhead are very long.

OBJECTS OF THE INVENTION

A general object of the invention is to devise an improved method and apparatus for installing and retrieving well components underwater, without diver assistance.

Another object is to provide such a method and apparatus which provides the capability of communicating with underwater components, such as tubing strings and fluid pressure operated well tools, while installation is being carried out, while maintaining effective blowout prevention capabilities.

A further object is to provide an improved method and means for installing multiple tubing strings in an underwater well while maintaining communication with the tubing strings and still affording effective blowout protection.

SUMMARY OF THE INVENTION

Apparatus embodiments of the invention comprise a fluid pressure operated tool secured to a composite handling joint which is of such length as to extend completely through the blowout preventers at the well head when the tool has been lowered to its working position, the composite handling joint presenting a rigid right cylindrical outer surface and having internal means which define the small flow conduits required to supply pressure fluid to the tool to operate the same and larger passages via which communication can be maintained with pipe in the well. Typically, such apparatus can be employed to install a multiple string tubing hanger in a given rotational position in the wellhead, and the larger passages through the composite handling joint are then employed to communicate each with a different one of the tubing strings throughout the operation while the smaller passages are employed to supply pressure fluid to specific portions of the tool to operate the tool to carry out such functions as latching and unlatching. According to method embodiments, the tool is connected to the composite handling joint, the handling string is then lowered to pass the tool through the blowout preventers and into the wellhead so that the composite handling joint extends completely through the preventers, and the tool is then remotely operated to carry out its intended function or functions while maintaining the capability of blowout prevention regardless of the rotational position of the composite handling joint relative to the blowout preventers.

IDENTIFICATION OF THE DRAWINGS

In order that the manner in which the foregoing and other objects are achieved according to the invention can be understood in detail, particularly advantageous method and apparatus embodiments of the invention will be described with reference to the accompanying drawings, which form part of the original disclosure in this application, and wherein:

FIG. 2 is a longitudinal sectional view, taken generally on line 2—2, FIG. 3, of the composite handling joint of FIG. 1;

FIG. 4 is an enlarged view, partly in longitudinal section and partly in side elevation, of the upper end portion of one of the pressure fluid conduits employed in the handling joint of FIGS. 1-3;

FIG. 5 is an enlarged fragmentary transverse sectional view illustrating a connection between a pipe and a receptacle forming part of the handling joint of FIGS. 1-3;

FIG. 6 is an enlarged fragmentary sectional view of a check valve assembly employed in the handling joint of FIGS. 1-3;

Figure 18:
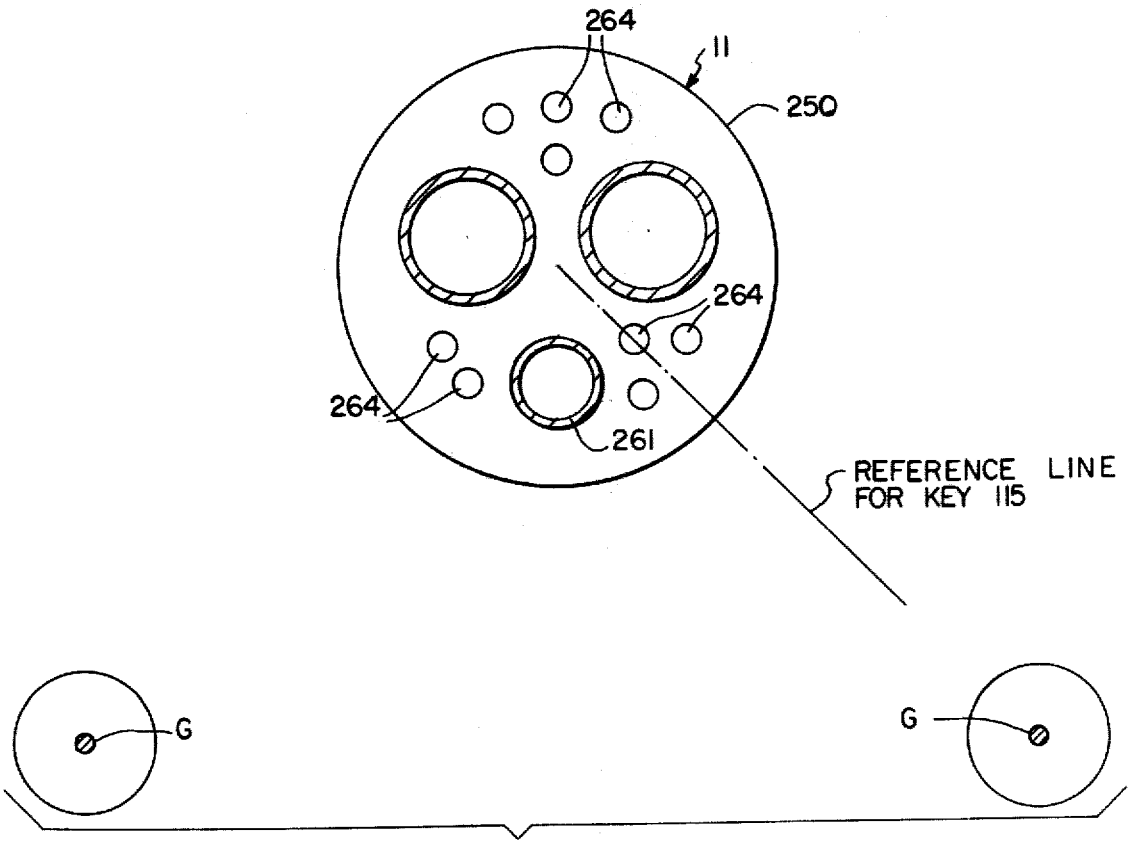
Figure 17:
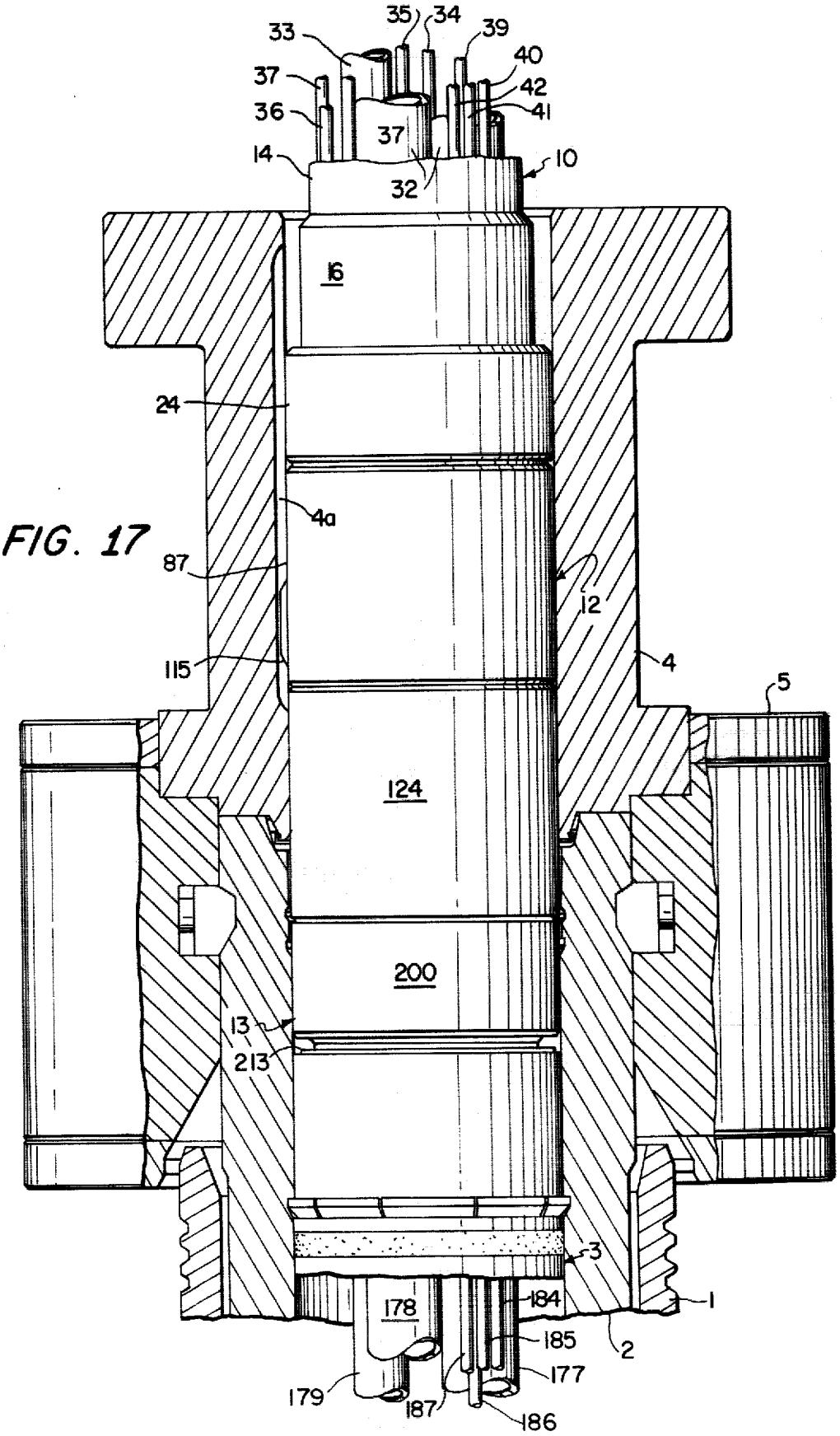
Figure 17A:
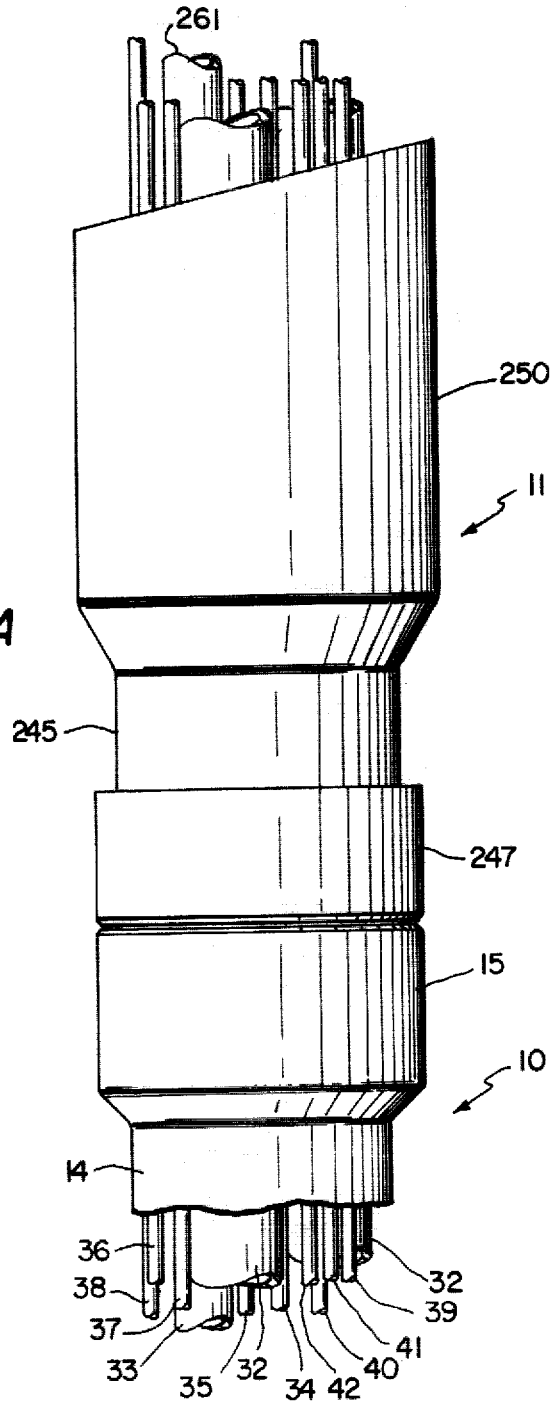

FIGS. 17 and 17A are views, partly in longitudinal cross section and partly in side elevation, showing the wellhead apparatus, with blowout preventers omitted for clarity, with the composite handling joint, multifunction tool, and tubing hanger in place after landing of the tubing hanger; and FIG. 18 is a diagram showing the relative position of various parts of the apparatus with respect to the guidance system.

DETAILED DESCRIPTION OF THE INVENTION

The invention is useful for all underwater well operations requiring that a well component or tool be installed, manipulated, serviced or retrieved remotely while maintaining communication with the well and preserving full effectiveness of the blowout preventers. For purposes of illustration, the invention will be described with reference to installation of multiple strings of tubing in a well in which the uppermost casing hanger is in place and the packing device for the casing hanger is to support the tubing hanger. Such wells are established with the aid of conventional guidance systems, such as that described in U.S. Pat. No. 2,808,229, issued Oct. 1, 1957, to Bauer et al, and the method and apparatus of this invention are employed with the aid of such a system.

Figure 1:
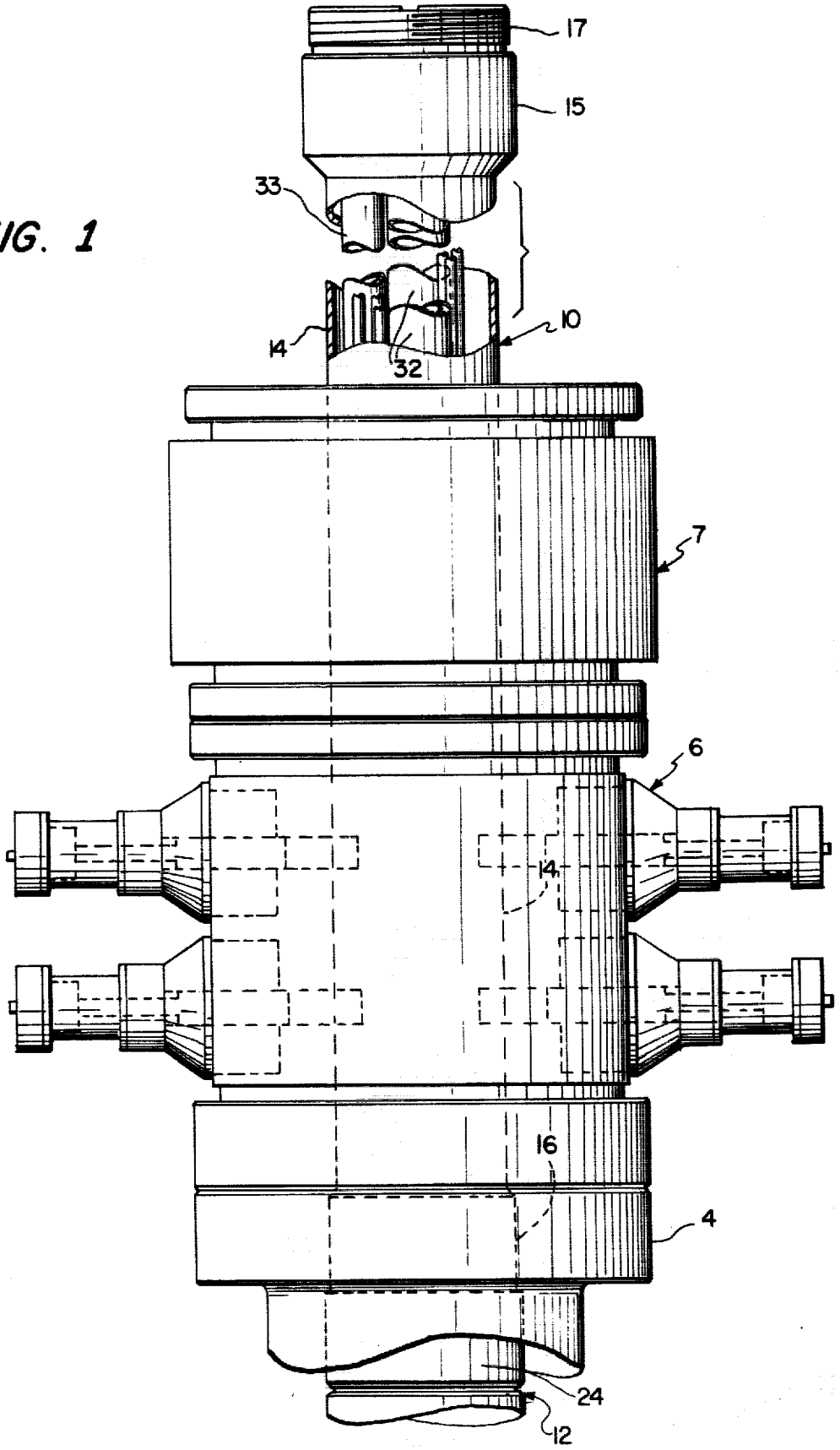
FIG. 1 is a side elevational view, with some parts broken away for clarity, of a portion of an underwater wellhead, including blowout preventers, showing a composite handling joint extending through the blowout preventers.

The well installation can comprise an outer casing 1 which supports a wellhead body 2 from which the inner casing (not shown) is suspended by casing hanger means including the casing hanger packoff device indicated generally at 3. The wellhead comprises an upper body 4 seated on body 2 and secured thereto by a conventional remotely operated connector 5 which can be of the type described in U.S. Pat. No. 3,228,715 issued Jan. 11, 1966, to Neilon et al. As seen in FIG. 1, upper body 4 supports the blowout preventer stack comprising a dual ram preventer 6 and, for redundancy, a bag preventer 7, the two preventers being sized as later described but being otherwise conventional. Upper body 4 has a longitudinally extending inwardly opening locator slot **4*a* and, installed with the aid of a guidance system, is so positioned that slot 4*a*** occupies a predetermined rotational position.

Figure 7:
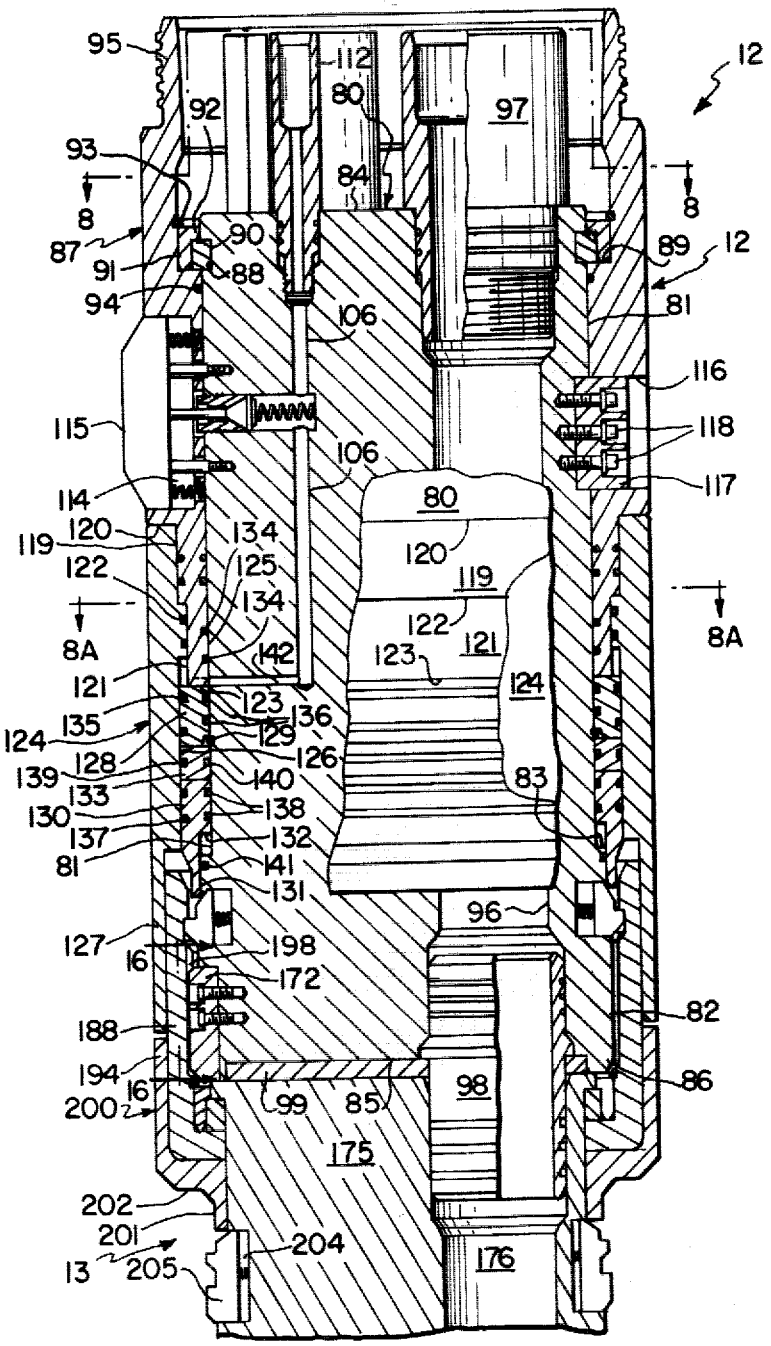
FIG. 7 is a longitudinal sectional view taken generally on line 7—7, FIG. 8, of a multipurpose handling tool according to the invention, with a multiple string tubing hanger carried thereby.
Figure 8:
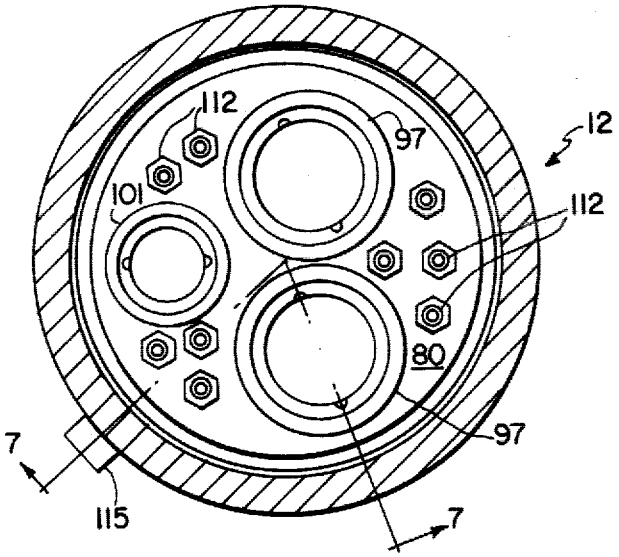
FIG. 8 is a transverse sectional view taken generally on line 8—8, FIG. 7.
Figure 8A:
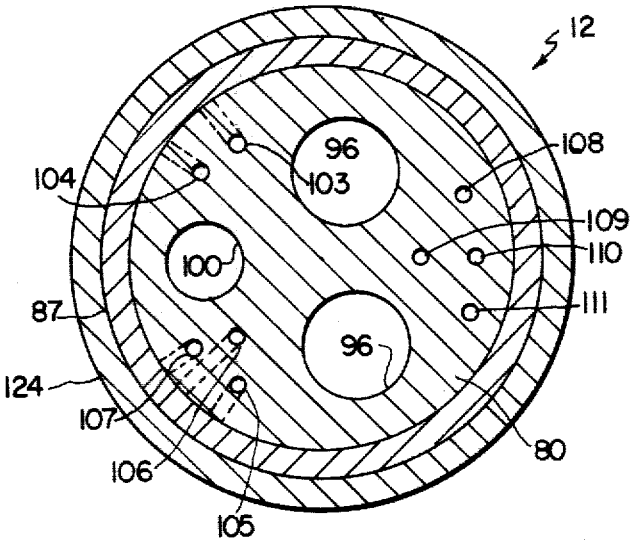
FIG. 8A is a transverse sectional view taken on line 8A—8A, FIG. 7.
Figure 8B:
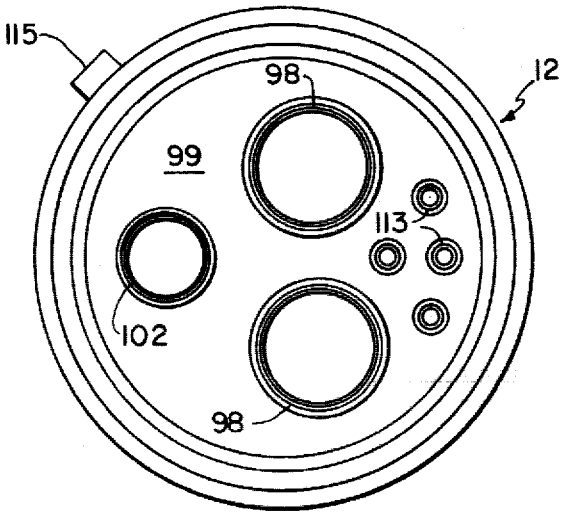
FIG. 8B is a bottom plan view of the tool of FIGS. 7-8A.
Figure 13:
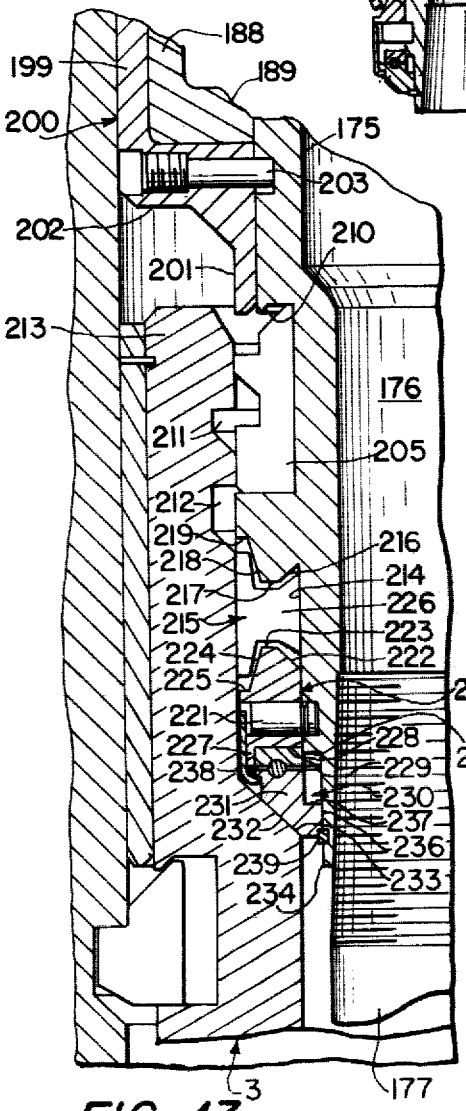
FIGS. 13 and 14 are fragmentary longitudinal sectional views, enlarged with respect to FIG. 11, showing parts of the tubing hanger in different operative positions.
Figure 14:
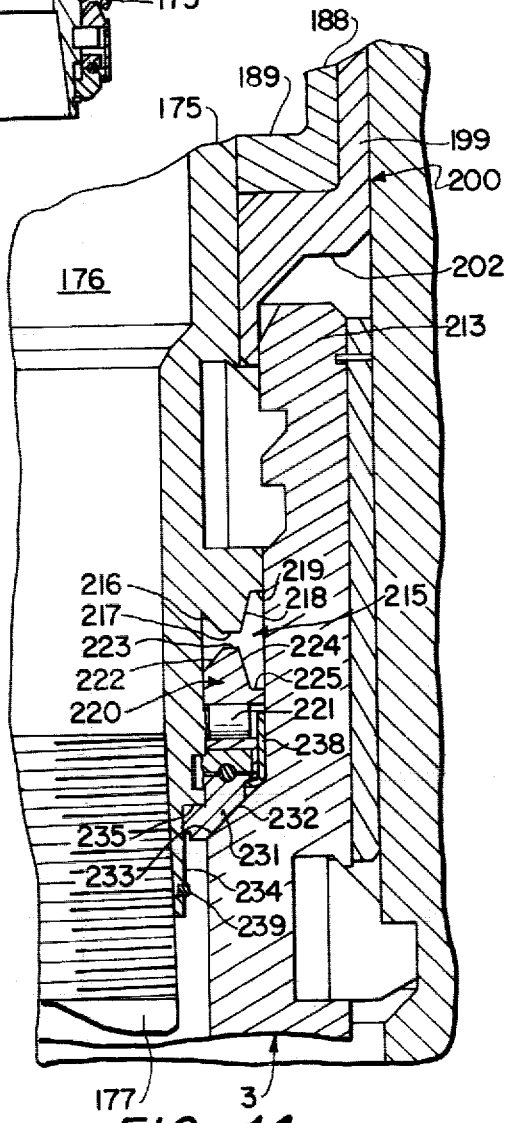
Figure 15:
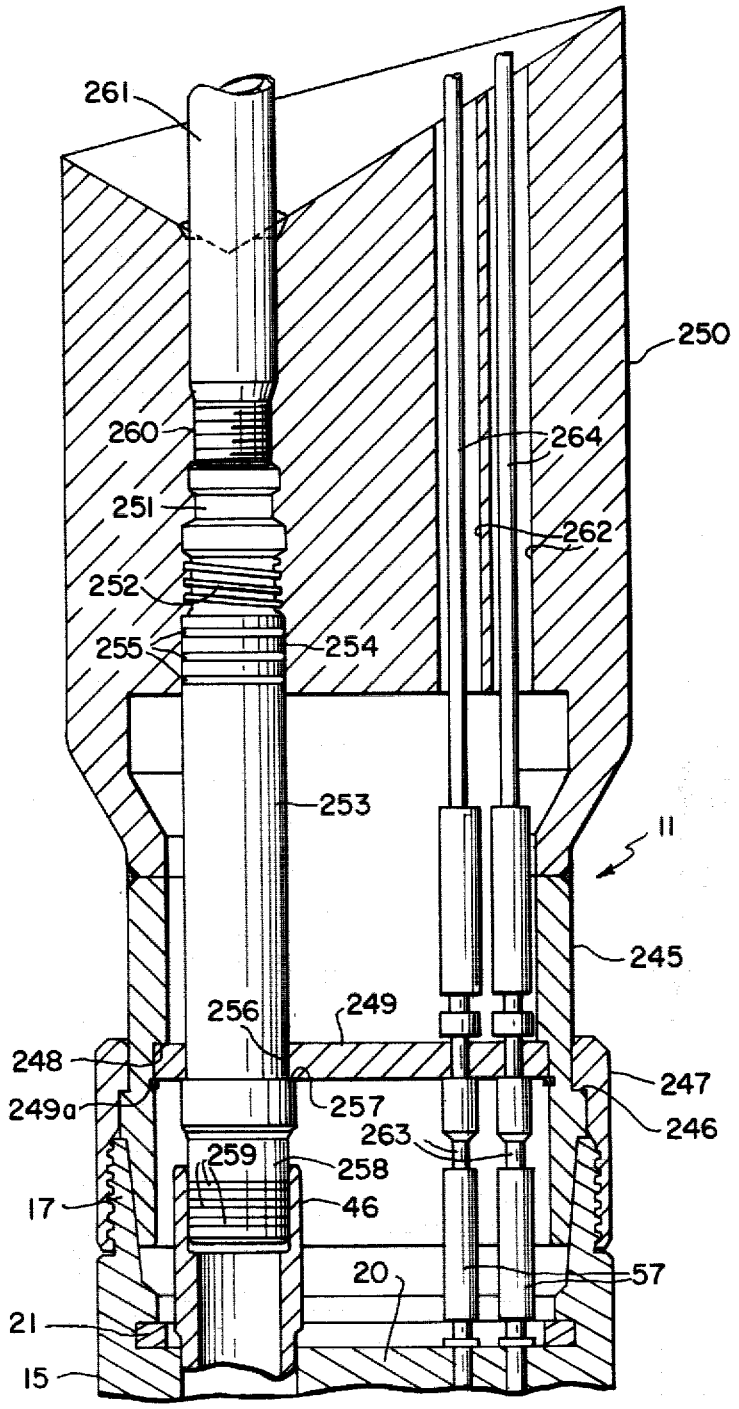
FIG. 15 is a longitudinal sectional view of a top closure body for the handling joint of FIGS. 2-7.
Figure 16:
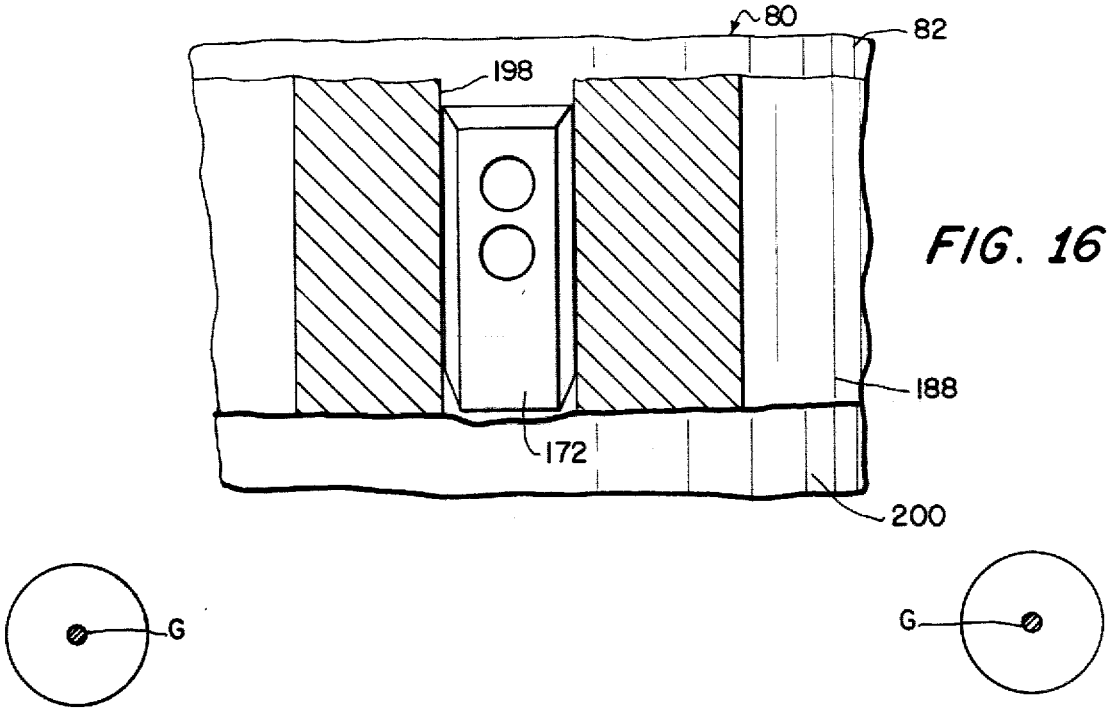
FIG. 16 is an enlarged fragmentary side elevational view, with parts broken away for clarity, of a locator key employed in the apparatus.

While the components just described are installed conventionally, further operations are carried out employing a composite handling joint 10, FIGS. 2-6, a top unit 11, FIG. 15, for the composite joint, a fluid pressure operated multifunction handling tool 12, FIGS. 7-8B, and a multiple string tubing hanger 13, FIGS. 11-14.

Composite Handling Joint

The composite handling joint 10 comprises a heavy wall cylindrical outer pipe 14 to the upper end of which is welded or otherwise rigidly secured a hub 15 of greater wall thickness than pipe 14. A hub 16 is similarly secured to the lower end of pipe 14.

Upper hub 15 has a male threaded connector portion 17 and a bore 18 slightly larger than the inner diameter of pipe 14, the inner end of bore 18 terminating at a transverse annular upwardly facing shoulder 19. A relatively thick closure plate 20 is embraced by the wall of bore 18 and seated on shoulder 19, the plate being secured by arcuate retaining segments 21 secured in an internal groove in hub 15.

Lower hub 16 has a transverse annular outwardly projecting flange 22 which cooperates with inturned flange 23 of a female threaded connector member 24. Internally, hub 16 has a bore 25, terminated at its upper end by shoulder 26, and a closure plate 27 is disposed in bore 25 and secured against shoulder 26 by segments 28 disposed in a transverse inwardly opening groove in the hub. Hub 16 includes a downwardly extending tubular nose portion 29 spaced inwardly from and concentric with the threaded skirt 30 of connector member 24, the outer surface of nose portion 29 being provided with sealing rings 31.

Figure 3:
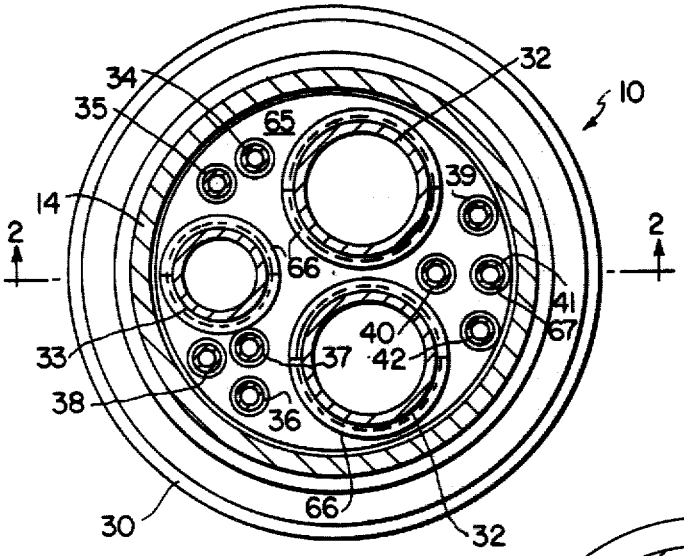
FIG. 3 is a transverse sectional view taken generally on line 3—3, FIG. 2.
Figure 12:
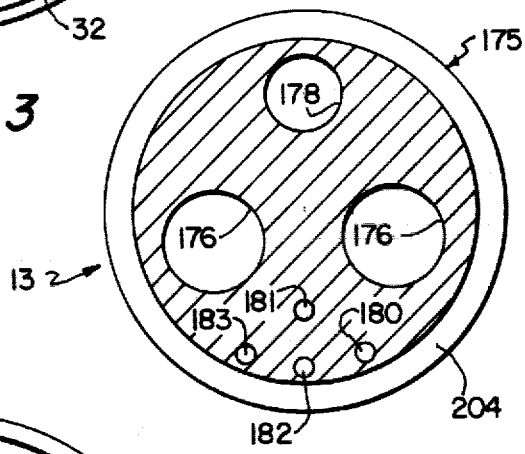
FIG. 12 is a transverse sectional view taken generally on lines 12—12, FIG. 11.

As will be clear from FIGS. 2 and 3, composite joint 10 comprises internal pipes defining a plurality of longitudinal passages through the joint. The inner pipes include two larger pipes 32 to communicate with two tubing strings, a smaller pipe 33 to communicate with the annulus of the well, and nine pressure fluid conduits 34-42. All of pipes and conduits 32-42 extend parallel to the longitudinal axis of outer pipe 14 and each pipe or conduit occupies a specific position determined by closure plates 20, 27. Closure plate 20 is secured in a given rotational position by a locator screw 43, FIG. 2, extending through a threaded radial bore in upper hub 15 into a coacting locator socket in the periphery of plate 20. Lower closure plate 27 is similarly secured in a given rotational position by locator screw 44.

Closure plate 20 has bores accommodating two larger receptacles 45, a smaller receptacle 46, and nine still smaller receptacles 47. Receptacles 45 are connected by threaded connections to the upper ends of the respective pipes 32, and receptacle 46 to pipe 33, each in the manner shown in FIG. 5. In each case, the receptacle includes an internally threaded skirt 48, FIG. 5, engaged over an externally threaded pipe end 49, with the joint sealed in fluid-tight fashion by a ring seal 50. The lower portions of receptacles 45, 46 extend within through bores in plate 20 and are sealed by ring seals 51 carried in grooves in the bore walls. Each receptacle 47, as best seen in FIG. 4, comprises an upwardly opening receptacle body 52 threadedly secured to the upper end of tubular body 53 passing through a bore in plate 20. Below plate 20, bodies 53 are each enlarged to provide a shoulder 54 coacting with an O-ring 55 to seal between the body and plate 20. Clamping pressure is applied by nuts 56 carried by bodies 5 above plate 20. Since conduits 34–42 are long, the upper ends of the conduits are connected to bodies 53 by slip joints 57 to make manufacturing tolerances less critical. To seal between the periphery of plate 20 and the wall of bore 18, plate 20 is provided with peripheral grooves accommodating seal rings 58.

At their lower ends, all of pipes 32, 33 and conduits 34–42 are provided with fittings having male threaded portions, as at 59 for pipe 33, engaged in threaded portions of corresponding bores in plate 27. The same bores similarly accommodate the male threaded upper end portions of dependent stingers 60 for pipes 32, stinger 61 for pipe 33, and nine stingers 62 for the respective conduits 34–42, suitable seals, as at 63, being provided between plate 27 and each stinger. To seal between the periphery of plate 27 and the wall of bore 25, the plate is provided with peripheral grooves accommodating seal rings 64.

At spaced locations along the length of the composite joint, pipes 32, 33 are secured together by plates 65 and ring clamps 66, as seen in FIG. 2. Plates 65 are of slightly smaller diameter than the inner wall of outer pipe 14 and include openings, as at 67, accommodating but not directly embracing the conduits 34–42. Thus, while plates 65 serve to stabilize the pipe bundle, they still allow longitudinal fluid flow in the space between the pipe bundle and the outer pipe.

Comparing FIGS. 1 and 2, it will be observed that the lower blowout preventers 6, when actuated, will close upon outer pipe 14 of composite joint 10 in a location spaced substantially above the lower hub 16 of the composite joint. Well below that location, and advantageously near the upper end of hub 16, the composite joint is provided with a lateral port 68, FIG. 6, accommodating a check valve 69 which is spring biased outwardly to closed position and can be urged inwardly to open, allowing fluid to flow from outside composite joint 10 into the internal space defined by pipe 14, hubs 15, 16 and closure plates 20 and 27, in response to high external pressures. In similar locations, the composite joint is equipped with at least one port normally closed by a conventional check valve 70 which can be constructed generally as seen in FIG. 6 but arranged to open to allow fluid to flow out of joint 10 only in response to presence of a pressure within the composite joint in excess of the external pressure by a predetermined differential value.

Multifunction Handling Tool

Tool 12 comprises a body member 80 having a right cylindrical outer surface including a portion 81 of smaller diameter and a lower end portion 82 of larger diameter, portions 81 and 82 being joined by a transverse annular upwardly facing shoulder 83. Body 80 has a flat top face 84 and is recessed at its bottom end to provide a flat bottom face 85 surrounded by a dependent peripheral flange 86, faces 84, 85 being at right angles to the longitudinal axis of the tool. Over a substantial upper portion of the length of surface portion 81, body 80 is embraced by a sleeve 87 which is rigidly secured to the body. In this embodiment, body 80 is provided with an outwardly opening groove 88, sleeve 87 has an upwardly facing shoulder 89, and the sleeve is secured by arcuate shear segments 90 seated in groove 88 but projecting outwardly to engage over shoulder 89. Segments 90 are held in place by a spacer ring 91 having an inwardly directed upper flange 92 extending over the segments, the spacer ring being secured by a snap ring 93 engaged in a transverse annular inwardly opening groove in sleeve 87. Below shoulder 89, sleeve 87 has an inner transverse groove accommodating a seal ring 94 to seal between the body and the sleeve.

The upper end portion of sleeve 87 projects beyond end face 84 and includes a portion 95 of reduced outer diameter, portion 95 being externally threaded and so dimensioned that its external threads can cooperate with the internal threads of portion 30, FIG. 2, of the female connector member 24 at the lower end of composite handling joint 10. When the connector comprising portions 30 and 95 is made up, the inner face of portion 95 embraces the outer face of portion 29 so that seal rings 31 form a fluid-tight seal between portions 29 and 95.

Body 80 includes two larger diameter through bores 96, a receptacle 97 being threaded into the upper end of each bore 96 in the manner seen in FIGS. 7 and 8, and the lower end of each bore 96 accommodating a dependent stinger 98 held in place by a retainer plate 99 which is bolted or otherwise secured in engagement with bottom face 85. Body 80 includes a third through bore 100, FIG. 8A, corresponding in size to pipe 33 of the composite joint, and the upper end portion of bore 100 accommodates a receptable 101, FIG. 8. The lower end of bore 100 accommodates a stinger 102, FIG. 8B, held in place by plate 99. Body 80 further comprises five small pressure fluid bores 103–107, FIG. 8A, which open through top face 84 and extend downwardly to terminate within the body and communicate with lateral bores later described. Body 80 is still further provided with four small through bores 108–111. At top end face 84, each of bores 103–111 accommodates a receptacle 112. At lower end face 85, each of bores 108–111 accommodates a dependent stinger 113, FIG. 8B.

For a considerable distance below shoulder 89, sleeve 87 is of substantial thickness and is provided with a rectangular recess 114 the long axis of which is vertical, the recess opening radially outwardly and slidably accommodating a locator key 115 dimensioned to coact with slot 4a, FIG. 17. Diametrically opposite recess 114, sleeve 87 has a window 116 snugly embracing a torque key 117 which is seated in a matching recess in body 80 and is secured rigidly to the body, as by screws 118. Below recesses 114, 116, sleeve 87 presents a first reduced diameter outer surface portion 119 terminating at its upper end in a transverse annular downwardly facing shoulder 120. Below surface portion 119 the sleeve has a second reduced diameter outer surface portion 121 joined at its upper end to surface portion 119 by a transverse annular downwardly facing shoulder 122. The lower end of sleeve 87 constitutes a downwardly facing shoulder at 123.

Below shoulder 120, body 80 is embraced by a movable sleeve 124 having an upper end portion slidably embracing surface portion 119, an inwardly directed transverse annular flange 125 slidably embracing surface portion 121, an intermediate portion presenting a right cylindrical inner surface 126 spaced outwardly from body surface portions 81, 82, and a dependent skirt 127 spaced outwardly from surface 126. Sleeve 124 coacts with body 80 and fixed sleeve 87 to define an annular cylinder an upper portion of which is the space between surface 121 and 126 and a lower portion of which is the space between surfaces 81 and 126. Immediately below shoulder 123, the annular cylinder is closed by a stationary ring 128 clamped between shoulder 123 and a snap ring 129 carried by a groove in body 80. An annular piston 130 is slidably disposed in the lower end portion of the cylinder and includes a dependent skirt 131 slidably embracing the upper end portion of surface 82, skirt 131 joining the body of piston 130 at a downwardly facing shoulder 132 opposed to shoulder 83. Between fixed ring 128 and piston 130, the annular cylinder slidably accommodates a second annular piston 133.

Flange 125 is provided with transverse inner grooves accommodating seal rings 134. Fixed ring 128 has external grooves accommodating seal rings 135 and internal grooves accommodating seal rings 136. Piston 130 has external grooves accommodating seal rings 137 and internal grooves accommodating seal rings 138. Piston 133 has an external groove accommodating seal ring 139 and an internal groove for seal ring 140. Immediately below shoulder 83, surface 82 has an outer groove accommodating seal ring 141.

Figure 7A:
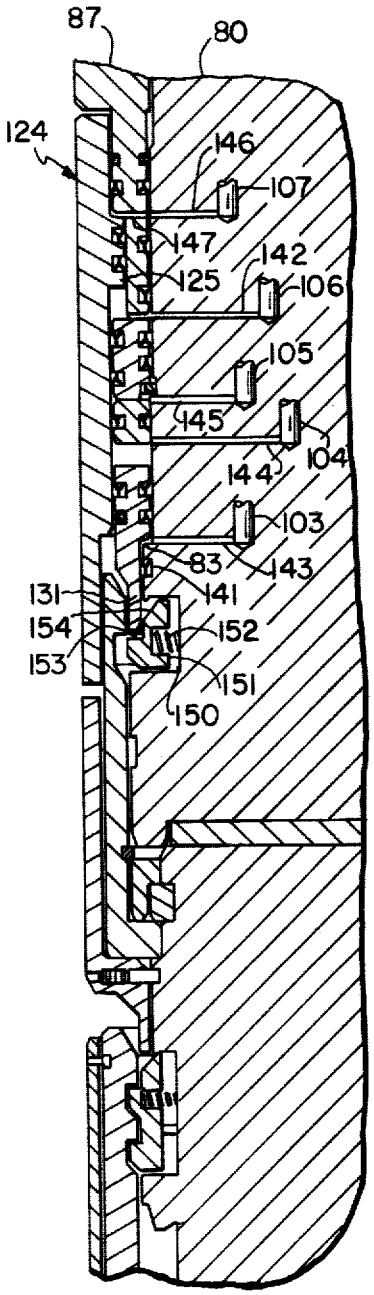
FIGS. 7A-7C are fragmentary longitudinal sectional views, with internal flow ducts shown diagrammatically, of the multipurpose tool of FIG. 7 showing parts of the tool in different operative positions.
Figure 7B:
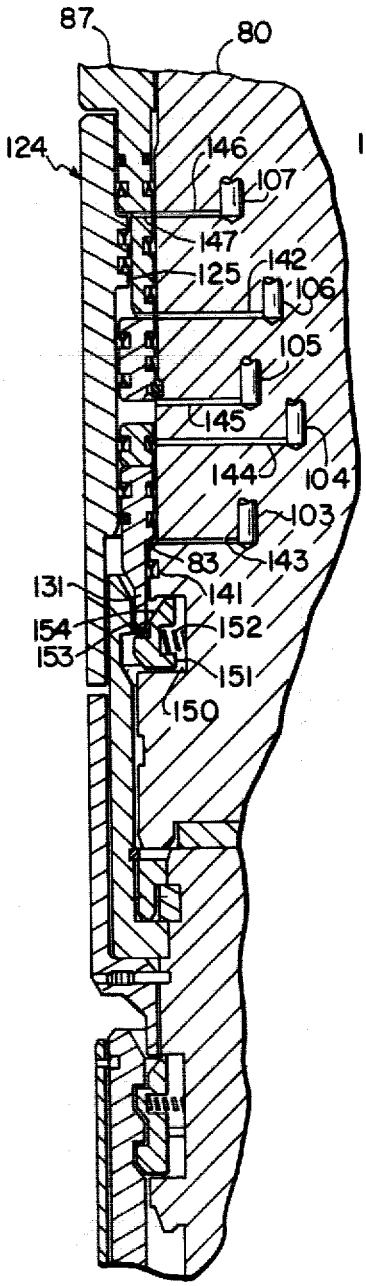
Figure 7C:
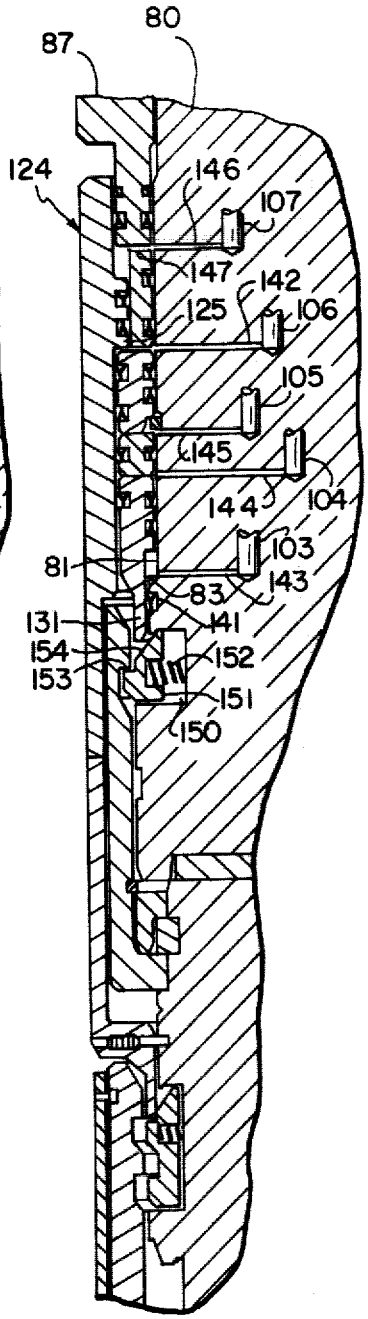

As seen in FIG. 7, the bottom end of bore 106 communicates with a lateral bore 142 which opens outwardly through surface 81 immediately above fixed ring 128, shoulder 123 being grooved to allow pressure fluid to flow from bore 142 into the space defined by the lower end of flange 125, inner surface 126 of sleeve 124, outer surface 121 of sleeve 87, and the upper end face of fixed ring 128. With pressure fluid thus applied, sleeve 124 is driven to the upper position seen in FIG. 7. FIG. 7 being taken on line 7—7, FIG. 8, only bore 106 of the five pressure fluid bores 103–107 appears in that figure, but all five bores are shown diagrammatically in FIGS. 7A–7C. As seen in FIGS. 7A–7C, the bottom end of bore 103 communicates with lateral bore 143 which opens outwardly through surface 81 immediately above shoulder 83. Bore 104 similarly communicates with a lateral bore 144 which opens through surface 81 in a location spaced below fixed ring 128 by a distance equal to the axial length of piston 133, while bore 105 communicates with a lateral port 145 opening outwardly through surface 81 at the bottom end face of fixed ring 128. Bore 107 communicates with a lateral port 146 which opens through surface 81 in the same transverse plane as shoulder 122 so as to communicate with a lateral duct 147, FIG. 7A, through sleeve 87 and thus communicates with the portion of the annular cylinder between shoulder 122 and the upper end of flange 125.

The lower end portion of body 80 has a transverse annular outwardly opening groove 150 in which are disposed a plurality of arcuate latch segments 151 arranged in a circular series. Segments 151 can be of the general type disclosed in U.S. Pat. No. 3,171,674, issued Mar. 2, 1967, to Bickel et al. Thus, each segment is biased outwardly by a spring 152 and has an upwardly facing latch shoulder 153 and an upwardly and inwardly tapering camming surface 154 which is disposed below skirt 131 of piston 130 when the segment is in its outer position.

Figure 9:
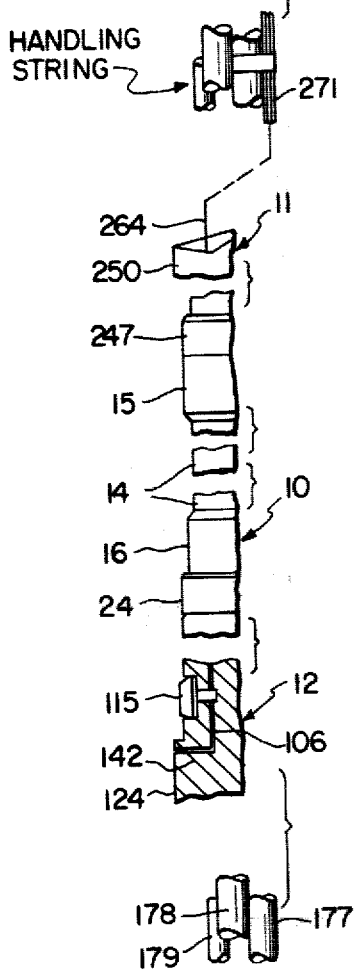
FIG. 9 is an enlarged fragmentary longitudinal sectional view of a combined locator key and position responsive valve forming part of the handling tool of FIGS. 7 and 8.
Figure 9:
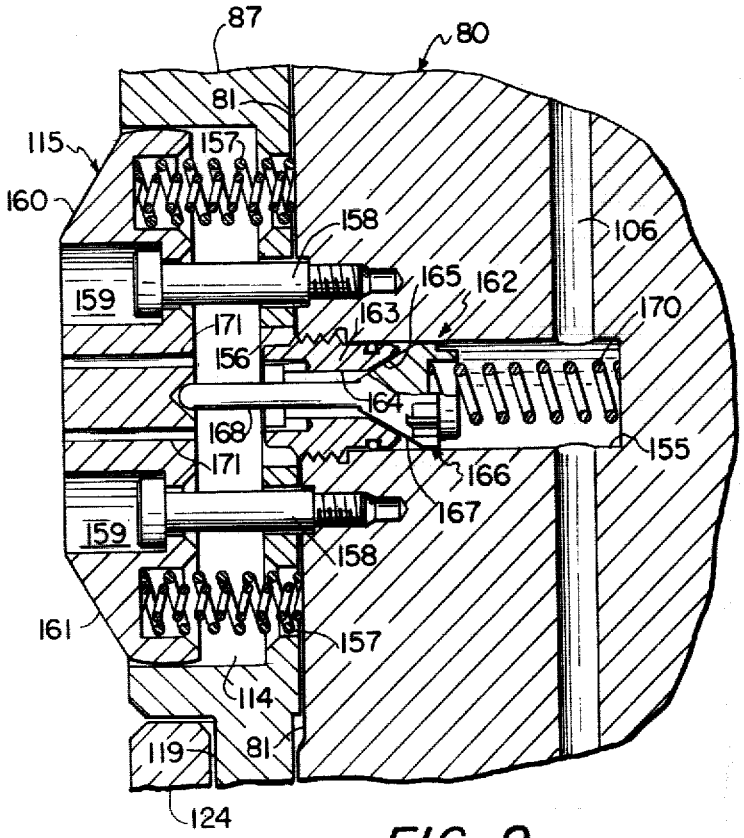
Figure 11:
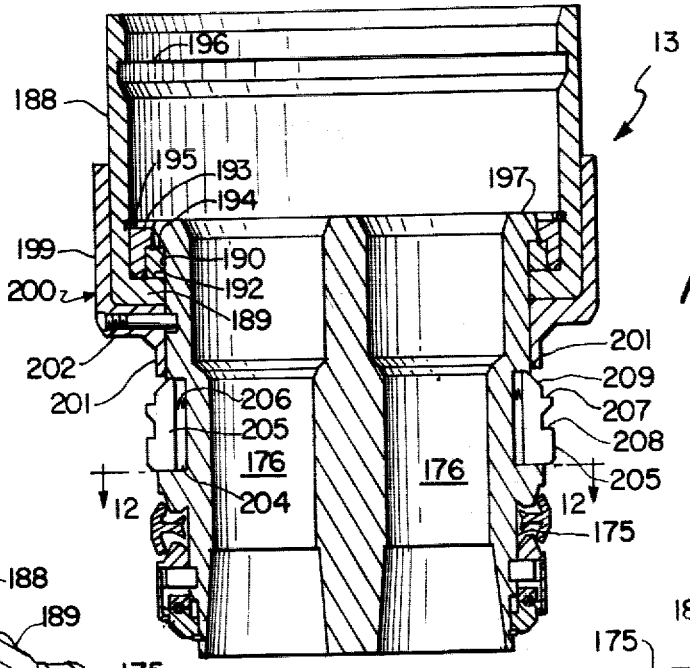
FIG. 11 is a longitudinal sectional view taken generally on line 11—11, FIG. 12, of the multiple string tubing hanger employed in the apparatus.

As best seen in FIG. 9, body 80 is provided with a radial bore 155 having an inner blind end portion interrupting bore 106 so that bore 106 communicates with bores 142 and 155 in parallel. Bore 155 is cylindrical and opens outwardly through surface 81 in a location centered on recess 114 in the assembled tool, and the inner wall of recess 114 has an opening 156 concentric with bore 155. Key 115 has two inwardly opening sockets which accommodate the outer ends of two helical compression springs 157, the inner end portions of the springs extending through openings in the inner wall of recess 114 and bearing on surface 81 of body 80, as shown in FIG. 9. Two guide screws 158 are provided, the inner threaded ends of the screws being engaged in threaded bores in body 80, the heads of the screws being disposed in sockets 159 in the face of locator key 115, the unthreaded shanks of the screws extending freely through openings in the body of the key. Thus, springs 157 urge key 115 to an outer position, seen in FIGS. 7 and 17, determined by engagement of the key with the heads of screws 158, but the key can be forced into recess 114 against the biasing action of springs 157. Key 115 has at its upper end an inwardly and upwardly slanting cam face 160 and, at its lower end, an inwardly and downwardly slanting cam face 161 to coact with the respective ends of slot **4*a*** and with any shoulders which may be encountered.

The outer end portion of bore 155 accommodates a check valve indicated generally at 162 and comprising an externally threaded bore 163 having an axial through bore 164 and, at the inner end of the body, a frustoconical valve seat 165. Cooperating with body 163 is a movable valve member having a head 166 which presents a frustoconical surface 167 capable of flush engagement with seat 165. The movable valve member also includes a rod 168 which projects axially from the small end of surface 167 and extends through bore 164 in body 163 into engagement in a socket at the center of the inner face of locator key 115. The movable valve member is urged toward body 163 by a compression spring 170 engaged between the blind end of bore 155 and the opposing end of head 166. Bore 164 is of significantly larger diameter than rod 168. A plurality of through bores 171 are provided in key 115 to allow fluid to flow outwardly from recess 114. The effective length of rod 168 is such that, when the key 115 is in its outermost position, surface 167 engages seat 165 under the force of spring 170 and the valve is closed but, when key 115 is forced inwardly into recess 114, rod 168 moves surface 167 inwardly away from seat 165 and the valve is open so that fluid can flow from bore 106 into bore 155, through the space between bore 169 and rod 168, into recess 114 and thence outwardly via bores 171.

At its lower end, body 80 is equipped with a rigidly attached torque key 172. cl Tubing Hanger Tubing hanger 13, FIGS. 11–14, comprises a hanger body 175 having two through bores 176, the upper end portions of bores 176 being enlarged to accommodate the stingers 98 of the multifunction tool 12, the lower end portions of bores 176 being threaded for connection respectively to the uppermost joints 177 of two tubing strings which depend from the tubing hanger and are equipped with conventional downhole safety valves (not shown). Body 175 also has through bore 178 which, at its upper end, accommodates stinger 102 of tool 12 and at its lower end is threadedly connected to the uppermost joint 179 of a third string of tubing depending from the hanger. Four additional bores 180–183, FIG. 12, extend through body 175, being equipped at their upper ends with receptacles to receive stingers 113 and being connected at their lower ends to conduits 184–187, respectively, which extend downwardly in the well from the tubing hanger to the downhole safety valves.

Hanger 13 is connected to multifunction tool 12 by means including a tubular connector member 188 provided at its lower end with an inturned flange 189 slidably embracing body 175. Above flange 189, body 175 has an outwardly opening transverse annular groove 190 accommodating a plurality of segments 192 which project outwardly from the groove to engage over flange 189. The latch segments are retained by a keeper ring 193 fitted between the segments and the wall of member 188 and provided with an upper inturned flange 194 engaged over the tops of the portions of segments 192 which project outwardly from groove 190. Member 188 has an internal groove accommodating a snap ring 195 engaging the upper end of keeper ring 193 to complete the rigid connection between member 188 and body 175.

The inner diameter of member 188 is such that member 188 can be slidably engaged over surface portion 82 of the body of the multifunction tool 12. Member 188 has a transverse annular inwardly opening latch groove 196 of such shape and location as to be capable of receiving the latch segments 151 of tool 12 when upper end face 197 of body 175 is engaged with the lower end face of portion 86 of tool body 80. Thus, when member 188 is fully telescoped over the lower end of body 80 of tool 12 and piston 130 is in its raised position, latch segments 151 snap outwardly into the groove 196 under the action of springs 152 so that the tubing hanger is latched to the multifunction tool in the manner shown in FIG. 7. Member 188 has an inwardly opening longitudinal inner groove 198 which accommodates the outwardly projecting portion of key 172 so that rotational forces applied to tubing hanger 13 via the handling string and tool 12 are applied directly from body 80 to member 188 via key 172, such forces then being applied directly to body 175 via elements 189, 195, 193 and 192.

When hanger 13 is secured to tool 12, dependent skirt 127 of sleeve 124 embraces the upper portion of member 188. The lower portion of member 188 is embraced by the upper portion 199 of a latch retracting sleeve 200. Lower portion 201 of sleeve 200 is of smaller diameter and slidably embraces body 175, portions 199 and 201 being joined by a transverse annular wall 202 underlying flange 189 of member 188 and being of adequate thickness to accommodate a shear screw 203 engaged in a recess in body 175 to retain the latch retracting sleeve in its upper, inactive position.

Below the lower tip of portion 201 of the latch retracting sleeve, body 175 has a transverse annular outwardly opening groove 204 accommodating an annular series of arcuate latch segments 205 which are biased outwardly by springs 206. Each segment 205 has two vertically spaced upwardly facing latch shoulders 207, 208 and an upwardly and inwardly slanting camming surface 209. As best seen in FIG. 13, the upper wall of groove 204 has a dependent outer lip 210 as a stop engaged by the upper end of surfaces 209 when the segments are urged to their outermost positions by springs 206. When, as seen in FIG. 14, segments 205 are in outer positions, camming surfaces 209 are exposed to be engaged by the tip of skirt 201. Latch segments 205 are dimensioned to be received by latch grooves 211, 212 in the inner surface of the upper member 213, FIGS. 13 and 14, of casing hanger packoff device 3, FIG. 17.

Below groove 204, body 175 is of reduced outer diameter, providing a cylindrical outer surface portion 214 embraced by a seal device, indicated generally at 215, of the general type described in U.S. Pat. No. 3,268,241, issued Aug. 23, 1966, to Castor et al. Surface portion 214 terminates at its upper end in an annular downwardly tapering nose portion defined by an inner frustoconical surface 216 which slants downwardly and outwardly, an intermediate flat transverse surface 217, an outer frustoconical surface 218 which slants downwardly and inwardly, and an outer flat transverse shoulder 219. Spaced below surface 217, a ring 220 slidably embraces surface portion 214 of body 175, being releasably secured to body 175 by a plurality of shear pins 221. Ring 220 presents an annular upwardly tapering nose portion defined by an inner frustoconical surface 222 which slants upwardly and outwardly, an intermediate flat transverse surface 223, an outer frustoconical surface 224 which slants upwardly and inwardly, and an outer flat transverse shoulder 225. The space between the two nose portions is occupied by a resiliently compressible sealing ring 226 having upper and lower surfaces conforming approximately to the two nose portions but so dimensioned as to accommodate a substantial movement of ring 220 upwardly on body 175 before the seal ring is compressed significantly.

At its lower end, ring 220 includes a dependent outer tubular flange 227 encircling a flat end face 228. The upper race member 229 of an antifriction ball bearing 230 is embraced by flange 227 and seated against face 228. Bearing 230 includes a lower race member 231 having a downwardly and inwardly tapering frustoconical load-bearing shoulder 232 capable of flush engagement with a support shoulder 233 presented by member 213 of packoff device 3. The lower end portion of body 175 is of still further reduced outer diameter so as to present surface portion 234 which terminates at its upper end in a transverse annular shoulder 235. While the inner diameter of the upper portion of race member 231 is sized to slidably embrace surface portion 214 of body 175, the race member includes an inturned flange 236 at its lower end which slidably embraces the smaller outer surface portion 234 of body 175 and presents an upwardly facing shoulder 237 which is opposed to but spaced below shoulder 235 when ring 220 is retained in its initial position by shear pins 221. The bearing is completed by an outer tubular shell 238 which has an inturned flange at its lower end engaged beneath a cooperating shoulder on lower race member 231, an O-ring being provided within the shell to seal between the lower race member and the lower edge of flange 227, as shown in FIGS. 13 and 14. Lower race member 231 is retained by a snap ring 239 secured in an outwardly opening groove at the lower end of body 175.

Considering FIG. 13, it will be noted that, when shear pins 221 are intact and shoulder 232 is engaged with shoulder 233, two conditions are maintained which promote maximum freedom of rotation for body 175 relative to lower race member 231 and shoulder 233. The first condition is that sealing ring 226 is essentially uncompressed because of the relatively large axial space between surfaces 216–219 of body 175, on the one hand, and surfaces 223–225 of ring 220, on the other hand. Hence, sealing ring 226 causes little frictional resistance to rotation of the tubing hanger. The second condition is that latch segments 205 are not engaged with any latching groove, being still too high to mate with grooves 211 and 212, and are in only rubbing engagement, under action of springs 206, with the main cylindrical inner wall olf member 213. Shear pins 221 are so selected that, e.g., 20% of the total weight of the string of pipes can be supported through ring 220 and bearing 230 without shearing the pins. Accordingly, as later described, the tubing hanger can be landed and then rotated, with, e.g., 80% of the weight supported from the operational base via the handling string. When the desired rotational position has been achieved, more or all of the weight of the string of pipes can be applied, with the result that pins 221 are sheared. Body 175 then descends until shoulder 235 engages shoulder 237. As seen in FIG. 14, such downwardly movement of body 175 brings latch segments 205 into mating relation with grooves 211, 212 and also fully compresses sealing ring 226 to effectively seal between body 175 and member 213. It will be noted that, when body 175 reaches the position seen in FIG. 14, the weight of the pipe strings depending from hanger 13 is supported on shoulder 233 through race member 231 and body 175, shoulders 230, 237 being in metal-to-metal contact, and the antifriction bearing being by-passed so far as support of the load is concerned. The combination of seal, bearing, shear pins and latch just described constitutes weight-set means which allows the bearing to have full effect when the hanger is initially landed, with the shear pins intact, but by-passes the bearing when the full weight of the tubing strings shears the pins and causes the hanger to descend to its finally landed position.

Top Unit for Composite Handling Joint

From FIG. 2, it will be apparent that a plurality of the composite joints 10 can be interconnected to form the entire handling string, when desired. Advantageously, only a singe composite joint 10 is used, in which case the upper end of the composite joint is closed by top joint 11, FIG. 15. Top unit 11 comprises a short length of heavy wall pipe 245 having outer shoulder 246 coacting with a female threaded coupling member 247 identical to member 24, FIG. 2. Internally, pipe 245 has a transverse annular downwardly directed shoulder 248 against which is seated a closure plate 249 retained by snap ring **249*a*. Rigidly secured to the upper end of pipe 245, as by welding, is a cylindrical closure body 250 provided with through bores disposed to be coaxially aligned with the respective receptacles 45–47 presented at the top of composite joint 10. Of these through bores, bore 251 is typical of those to be aligned with the two receptacles 45 and receptacle 46. At its lower end, bore 251 includes a threaded portion to accept the threaded upper end 252 of a stinger 253. Below such threaded engagement with the stinger, bore 251 includes a cylindrical portion to accommodate an unthreaded portion 254 of the stinger, portion 254 being equipped with seal rings at 255. Stinger 253 extends through an opening 256 in plate 249 and has a transverse annular shoulder 257 engaged with the bottom face of plate 249. Lower end portion 258 of stinger 253 is dimensioned for downward insertion into receptacle 46 of the composite joint 10 and is equipped with seal rings 259 to seal between the stinger and receptacle. The upper end portion of bore 251 is threaded, as at 260, to receive the threaded lower end of a pup joint 261 of the same internal diameter as pipe 33, FIG. 2. Save for dimensions, the bores and stingers to cooperate with the two receptacles 45 of composite joint 10** are identical to those just described.

Body 250 is also provided with nine plain through bores 262 so located that, when top unit 11 is connected to the upper end of composite joint 10 by cooperation of member 247 with male thread portion 17, FIG. 2, each bore 262 is coaxial with a different one of the nine receptacles 47. Closure plate 249 has through bores corresponding respectively to bores 262 and accommodating the stingers 263 to cooperate with receptacles 47. Conduits 264 extend upwardly from stingers 263 and through the respective bores 262. Above body 250, conduits 264 are grouped into a composite bundle to extend beside and be strapped to one of the larger pipes which serves as the handling string by which the combination of composite joint 10 and top unit 11 is manipulated.

Installation of Tubing Hanger

Figure 3A:
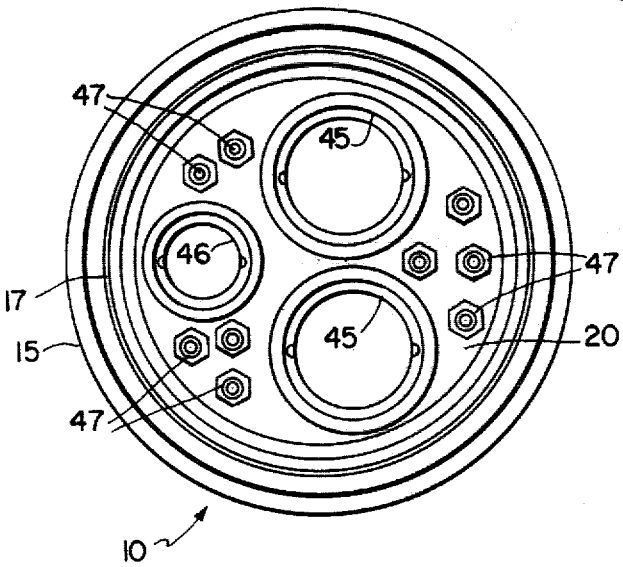
FIG. 3A is a top plan view of the composite handling joint of FIG. 1.
Figure 10:
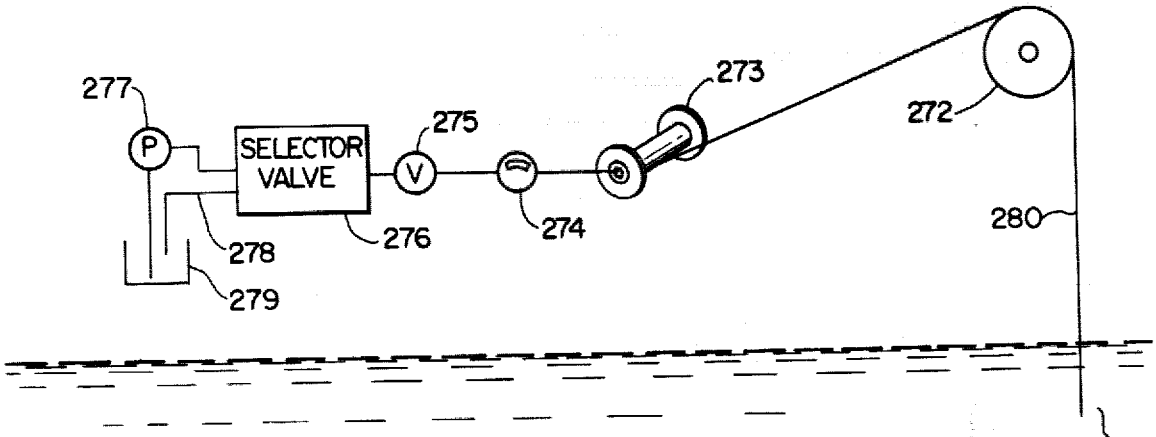
FIG. 10 is a semidiagrammatic view of the hydraulic circuit for the handling tool of FIGS. 7 and 8.

Installation of tubing hanger 13 by use of the foregoing apparatus is illustrative of method embodiments of the invention. Working at the operational base at the water surface, handling tool 12 is connected to composite handling joint 10. With composite joint 10 upright, screw plugs 270, FIG. 3A, are removed from corresponding bores in closure plate 20 and the composite joint 10 is completely filled with water, using one bore for filling and the other to vent air from the interior space of joint 10, care being taken to remove substantially all air from joint 10. Plugs 270 are replaced and top unit 11 then connected to joint 10. The pup joints for the two larger handling pipes are installed on unit 11. Tubing hanger 13 is connected to tool 12 and bores 103 and 106 are pressurized to assure that pistons 130, 133 and sleeve 124 are in their upper positions, pressure being maintained in bore 103 until the tubing hanger has been landed. The tubing strings comprising joints 177–179, FIG. 17, and the downhole safety valve conduits 184–187 are made up to the tubing hanger. Using the conventional guidance system, the combination of composite joint 10, handling tool 12 and hanger 13 is positioned rotationally so that locator key 115 of handling tool 12 is so located relative to guide lines G, FIG. 18, as to be displaced, e.g., 30° counterclockwise from the location of locator slot **4*a*, FIG. 17, in the wellhead upper body 4. The nine independent flexible tubes of a composite hose 271, FIG. 10, are then connected respectively to the upper ends of the conduits 264, composite hose 271 being strapped to one of the handling string pipes and extending upwardly over a sheave 272 and thence to a storage reel 273 where a length of the hose adequate to extend from the operational base to the wellhead is stored. Each tube of hose 271 is connected via a swivel joint (not shown) of the reel 273 to the series combination of a pressure indicating gauge 274, an on-off valve 275 and a selector valve 276. Valve 276 is a conventional valve operative to selectively connect certain of the tubes of composite hose 271, and thus selected ones of the conduits 264, to the output of a pump 277, while another related tube is connected, as the return, to a pipe 278 leading to the supply 279 from which pump 277** draws hydraulic fluid.

At this stage, sleeve 124 and annular pistons 130 and 133 of tool 12 are in their uppermost positions, seen in FIG. 7, and latch segments 151 and 205 are therefore urged outwardly by their respective biasing springs. Locator key 115 is biased outwardly by its spring 157, FIG. 9, so that valve 162 is closed, and with hydraulic fluid supplied by pump 277 via tube 280, FIG. 10, the one of ducts 264 communicating with conduit 37 and bore 106 will be applied, without loss, via lateral duct 142, FIG. 7, to the portion of the annular cylinder between flange 125 of sleeve 124 and fixed ring 128, so full hydraulic pressure will appear in that portion of the annular cylinder and will be indicated by gauge 274.

Using a conventional derrick, draw works and motion compensators, the handling string is now made up and lowered to run the composite handling joint 10, tool 12 and hanger 13 to the wellhead and through the blowout preventers until shoulder 232 of the hanger lands on shoulder 233 of packoff device 3. The major part, e.g., 80% of the total weight of the tubing and handling strings is supported at the operational base, so that only 20% is supported through shoulders 232, 233 and shear pins 221 therefore remain intact.

As tool 12 enters the blowout preventer stack, locator key 115 is cammed inwardly by the surrounding bore wall and remains in an inward position, so that valve 162 is open as tool 12 enters wellhead upper body 4, since the rotational position of tool 12 was selected at the outset so that key 115 was displaced from locator slot 4a. With valve 162 open, hydraulic fluid supplied from pump 277 via tube 280, conduits 264 and 37, and bores 106 and 142 is allowed to escape via valve 162 and bores 171, so a marked reduction in pressure is shown by gauge 274, indicating that locator key 115 is not seated.

When shoulders 232, 233 are engaged, the handling string is rotated clockwise in order to bring locator key 115 of tool 12 into registry with slot 4a, and the key snaps outwardly into the slot. Engagement of key 115 in slot 4a provides two indications of the occurrence, both observable at the operational base. The first indication is the usual abrupt resistance to further turning of the handling string. The second indication is the return of gauge 274 to full pressure indication, occurring because, as key 115 moves radially outwardly into groove 4a, valve 162 is closed under the influence of its spring 170. The second indication corroborates the first, proving that the locator key 115 has in fact engaged in slot 4a.

Engagement of key 115 in slot 4a secures tool 12, and therefore hanger 13, at that rotational orientation predetermined for the hanger, so that the orientation of the bores 176, 178 and 180–183 through the hanger body 175 relative to the guidance system is known. With key 115 engaged in slot 4a, the full weight of the string is now applied to the tubing hanger by relieving the strain on the handling string. As a result, shear pins 221 are sheared, and body 175 of hanger 13 descends to the position seen in FIG. 14, so that latch segments 205 engage in grooves 211, 212 to latch the tubing hanger in place and the full weight of the tubing strings is removed from bearing 230, being now supported by direct engagement of shoulders 235, 237. During the transition from the FIG. 13 position to that in FIG. 14, there can be no relative rotational shifting between handling tool 12 and hanger 13 since the stingers of the tool are engaged in the receptacles of the hanger and torque key 172 is engaged in slot 198.

Throughout landing of tubing hanger 13, outer pipe 14 of composite handling joint 10 extends completely through both blowout preventers 6 and 7. The rams 6a of preventer 6 have arcuate faces 6b of a diameter equal to the outer diameter of pipe 14, and bag preventer 7 is also sized to coact with pipe 14 when the preventer is energized. Thus, preventers 6 and 7 can be operated to seal against pipe 14 if the well should "kick" at any time during installation of the tubing strings, whether hanger 13, tool 12 and joint 10 are in their initial rotational position or the final rotational position, since proper engagement of the blowout preventers with pipe 14 is completely independent of the rotational position of pipe 14.

As composite handling joint 10 descends toward the wellhead, the increasing hydrostatic head may reach a value sufficient to open valve 69 if any substantial amount of air is entrained in the water filling the composite joint. In that event, valve 69 serves to equalize the pressures within and outside the composite joint. Should the well kick after the tubing hanger has been landed, blowout preventers 6 are actuated to seal the well annulus, and if that occurs, the full well pressure appears in the annulus about pipe 14 below the preventer rams 6a. Under those circumstances, the high well pressure is admitted to the interior space of the composite joint via valve 69, thus eliminating the large pressure differential which would otherwise tend to crush pipe 14. Under normal practices, the well is then "killed" by pumping mud into the annulus, after which the pressure in the annulus about pipe 14 below the preventer rams decays, tending to cause a large pressure differential across the wall of pipe 14 in the opposite sense, i.e., acting from within the composite joint. However, this pressure is relieved by exhaust of fluid through valve 70, so that the pressure within composite joint 10 returns to a relatively low value at which it is safe to return the composite joint to the operational base at the surface of the body of water.

Throughout the entire operation of landing, orienting and securing hanger 13, full communication is maintained between the operational base at the water surface, on the one hand, and the tubing strings, downhole safety valves or other hydraulic equipment, and handling tool 12, on the other hand.

With tubing hanger 13 successfully landed, oriented, and latched to packoff device 3, handling tool 12 can be remotely disconnected from the tubing hanger by operating selector valve 276 to pressurize the tubing of composite hose 271 which communicates with bores 104, 144 of tool 12, bores 143, 103 then acting to vent. As seen in FIG. 7A, pressurization of bores 104, 114 drives piston 130 downwardly, so the skirt 131 comes into engagement with camming surfaces 154 of latch segments 151 and cams the latch segments inwardly into grooves 150 to such an extent that the tips of the latch segments are disengaged from groove 196 of connector member 188. Tool 12 is now free for upward withdrawl.

Should pressurization of bores 104, 114 be unsuccessful in unlatching tool 12 from hanger 13, a secondary means is provided for that purpose. Thus, selector valve 276 can be operated to pressurize bores 105, 145 of tool 12 and supply pressure to the space between secondary piston 133 and fixed ring 128, so that the combination of pistons 133, 130 is therefore driven downwardly to cause skirt 131 to retract latch segments 151 as seen in FIG. 7B.

Reentry Into Tubing Hanger

The combination of tool 12 and composite handling joint 10 is also employed when it is necessary to reenter tubing hanger 13, as when the tubing hanger and tubing strings are to be retrieved. Made up as earlier described, the handling string is lowered, using a derrick, draw works and motion compensators which can be set to support a given proportion of the hook weight. When tool 12 has descended to approximately one joint above hanger 13, the motion compensators are set to support all but 10–20,000 lbs. of the hook weight. Selector valve 276 is operated to pressurize both bores 106 and 103 of tool 12. Since, as when landing the tubing hanger, the initial orientation of tool 12 positions key 115 a substantial distance clockwise from slot 4a, entry of the tool into the blowout preventers causes key 115 to be cammed inwardly and valve 162 to open. The handling string is now lowered to land tool 12 gently on hanger 13, with the bottom end of key 172 engaging the upper edge of connector member 188 of the hanger. The handling string is then rotated until key 115 engages in slot 4a, causing valve 162 to close so that gauge 274 shows an increase of pressure applied via bores 106, 142. When key 115 enters slot 4a in the wellhead upper body, torque key 172 simultaneously enters slot 198 in member 188. The handling string is now further lowered to insert tool 12 fully into member 188, bringing tool body 80 into engagement with hanger body 175. Latch segments 151 are now moved outwardly by their springs 152 to engage in groove 196 in member 188, thus securing tool 12 again to hanger 13. Communication is thus reestablished with tubing 177–179, FIG. 17, via the respective pipes 32, 33 in the composite handling joint.

If the hanger and tubing strings are to be recovered, selector valve 276 is operated to pressurize bores 107, 146 and connect bore 106 to discharge, so that pressure fluid is introduced between flange 125 of sleeve 124 and shoulder 122 to drive sleeve 124 downwardly on body 80. Skirt 127 of sleeve 124 engages the top of latch retracting sleeve 200 so that shear screw 203 is sheared and sleeve 200 is driven downwardly relative to body 175, with skirt 201 engaging the camming surfaces 209 of latch segments 205 so that the latch segments are forced inwardly in groove 204 and disengaged from grooves 211, 212. The handling string can now be raised to retrieve joint 10, tool 12, hanger 13 and the tubing strings.

What is claimed is:

1. The method for carrying out operations in an underwater well installation from an operational base at the surface of the body of water when the well installation comprises an underwater wellhead body supporting blowout preventers, comprising providing a composite handling joint which presents an outer cylindrical surface longer than the effective length of the blowout preventers, the handling joint defining at least one larger diameter longitudinal passage to be placed in communication with pipe in the well, a plurality of small longitudinal pressure fluid passages, and internal space surrounding said passages;

providing a handling tool comprising movable fluid pressure operated means, means defining pressure fluid passages for controlling flow of pressure fluid to operate the movable means, and passage means for communicating with pipe in the well;

securing the handling tool to the lower end of the composite handling joint with the pressure fluid passages of the tool in communication with respective ones of the pressure fluid passages in the composite handling joint and with said passage means of the tool communicating with said at least one larger diameter passage of the composite handling joint;

filling with liquid the internal space surrounding the passages in the composite handling joint;

lowering the composite joint and handling tool from the operational base with the aid of guidance means to position the handling tool in the wellhead with the cylindrical outer surface of the composite handling joint then extending through the blowout preventers;

operating the handling tool remotely by pressure fluid supplied via pressure fluid passages of the composite joint;

maintaining communication between the operational base and pipe in the well via the at least one larger diameter passage of the composite handling joint, the outer surface of the composite handling joint being operatively presented to the blowout preventers throughout the step of operating the handling tool, whereby successful operation of the blowout preventers is made independent of the rotational position occupied by the composite handling joint; and admitting fluid under pressure to the internal space surrounding the passages within the composite handling joint when pressure external to the composite handling joint exceeds a predetermined value.

2. The method defined in claim 1 and further comprising discharging fluid from the internal space of the composite handling joint to reduce the pressure within the internal space; and then raising the composite handling joint to the operational base to recover the composite handling joint.

3. The method defined in claim 1, wherein the step of admitting fluid under pressure to the internal space of the composite handling joint is carried out during lowering of the composite handling joint from the operational base to the wellhead location.

4. The method defined in claim 1, wherein the step of admitting fluid under pressure to the internal space of the composite handling joint is accomplished by opening a port in the wall of the handling joint which is below the blowout preventers when the handling tool has been operatively positioned in the wellhead.

5. The method according to claim 4, wherein the step of admitting fluid under pressure to the internal space of the composite handling joint is carried out after operation of the blowout preventers to seal with the outer surface of the composite handling joint.

6. The method for installing multiple strings of tubing in an underwater well installation of the type comprising wellhead structure including an upwardly exposed support for a tubing hanger, a wellhead body member above and adjacent to the support and presenting a rotational orientation reference, and blowout preventer means mounted on the wellhead body member, comprising providing a composite handling joint which presents a cylindrical outer surface longer than the effective height of the blowout preventer means, the handling joint defining a plurality of larger diameter longitudinal passages equal in number to the strings of tubing to be installed, and at least one small longitudinal pressure fluid passage;

providing a handling tool comprising a handling tool body, fluid pressure operated connector means carried by the handling tool body, pressure fluid passage means arranged to supply pressure fluid to operate the connector means, a plurality of larger diameter passages equal in number to the strings of tubing to be installed, and locator means constructed and arranged to cooperate with the rotational orientation reference of the wellhead body means;

securing the handling tool rigidly to the composite handling joint with the pressure fluid passage means of the tool communicating with the at least one pressure fluid passage of the composite joint and with the larger diameter passages of the handling tool communicating each with a different one of the larger diameter passages of the composite handling joint;

securing the last joints of the tubing strings to a multiple string tubing hanger having a body, a support member presenting a downwardly facing shoulder adapted to be landed on the upwardly exposed support of a wellhead structure, rotary bearing means between the support member and the tubing hanger body, and weight-set means constructed and arranged to maintain the tubing hanger initially in condition for rotation of the tubing hanger body relative to the support member when the support member of the hanger has been landed on the upwardly exposed support of the wellhead structure;

releasably securing the body of the tubing hanger to the handling tool by the fluid pressure operated connector means of the handling tool;

lowering the combination of the composite handling joint, handling tool and tubing hanger from the operational base with the aid of guidance means until the support member of the tubing hanger lands upon the upwardly exposed support of the wellhead structure, the handling tool is within the wellhead body member, and the composite handling joint extends through the blowout preventer means;

rotating the combination of the composite handling joint, handling tool and tubing hanger body until the locator means of the handling tool cooperates with the orientation reference of the wellhead body member to establish a predetermined rotational position for the tubing hanger, the step of rotating the composite handling joint, handling tool and tubing hanger being carried out while supporting a predominant portion of the weight of the tubing strings, hanger, handling tool and composite handling joint from the operational base;

then reducing the support from the operational base to allow the weight of the tubing strings, hanger, handling tool and composite joint to actuate the weight-set means of the tubing hanger and thus complete landing of the tubing hanger in its predetermined rotational position;

releasing the connector means of the handling tool by pressure fluid supplied via the at least one pressure fluid passage of the composite handling joint and thereby disconnecting the handling tool from the tubing hanger; and recovering the composite handling joint and handling tool.

7. The method according to claim 6, wherein the composite handling joint is short in comparison to the distance between the wellhead structure and the operational base; and manipulation of the combination of the composite handling joint, handling tool, tubing hanger and tubing strings is accomplished by means of a handling string comprising separate strings of pipe connected to the upper end of the composite handling joint and each communicating with a different one of the larger diameter passages of the composite handling joint and, via those passages, with a different one of the tubing strings.

8. In an underwater well apparatus, the combination of underwater wellhead means including upright body means defining an upright through bore, an upwardly exposed tubing hanger support disposed in the through bore, rotational orientation reference means exposed to the through bore and located above the tubing hanger support, and blowout preventer means mounted on the body means and located above the orientation reference means;

handling string means capable of extending from an operational base at the surface of the water downwardly to the wellhead means and including a composite lowermost joint defining a plurality of larger diameter longitudinal passages, and at least one small longitudinal pressure fluid passage;

a handling tool comprising body means rigidly secured to the lower end of the composite lowermost joint of the handling string means and having a plurality of larger diameter through passages each communicating with a different one of the larger diameter longitudinal passages of the composite lowermost joint, and at least one pressure fluid passage communicating with the corresponding pressure fluid passage of the composite lowermost joint, locator means carried by the body means and constructed and arranged to cooperate with the rotational orientation reference means of the wellhead means, and fluid pressure operated connector means;

a multiple string tubing hanger comprising a body having a plurality of through passages to cooperate with tubing strings, an annular support member presenting a downwardly facing shoulder adapted to be landed on the upwardly exposed tubing hanger support of the wellhead means, rotary bearing means operatively disposed between the annular support member and the tubing hanger body, and weight-set means constructed and arranged to maintain the tubing hanger in initial freedom for rotation relative to the annular support member when the annular support member has been landed on the upwardly exposed tubing hanger support of the wellhead means and a major portion of the weight of the tubing strings is still supported by the handling string means, the weight-set means allowing the tubing hanger body to descend relative to the annular support member into fully landed position when support via the handling string means ceases; and a plurality of well tubing strings secured to and depending from the tubing hanger;

the effective lengths of the composite lowermost joint of the handling string means, the handling tool and the tubing hanger being such that, when the annular support member of the tubing hanger is initially landed on the upwardly exposed tubing hanger support of the wellhead means, the handling tool is disposed in the wellhead body means in a location such that the locator means of the handling tool will cooperate with the orientation reference means of the wellhead means upon rotation of the handling tool, and the composite lowermost joint of the handling string means extends through the blowout preventer means;

the composite lowermost joint of the handling string means having a rigid cylindrical outer surface of a length to extend through the blowout preventer means, the blowout preventer means being constructed and arranged to seal against said outer surface of the composite lowermost joint;

the combination of the composite lowermost joint of the handling string means, the handling tool and the body of the tubing hanger being rigid and capable of accepting loads in compression and in tension as well as rotational loads.

9. The combination defined in claim 8, wherein the composite lowermost joint of the handling string means is hollow and the portion thereof within the cylindrical outer surface is closed against longitudinal flow of fluid save via said longitudinal passages.

10. The combination defined in claim 9, wherein the composite lowermost joint of the handling string means is provided with an opening communicating between the space within the hollow composite joint and the exterior; and the combination further comprises check valve means normally closing said opening but operative to admit fluid via said opening in response to occurrence of a predetermined higher external pressure.

11. The combination defined in claim 10, wherein the composite lowermost joint of the handling string means is provided with a second opening communicating between the space within the hollow composite joint and the exterior; and the combination further comprises second check valve means normally closing said second opening but operative to permit fluid flow outwardly via said second opening in response to occurrence of a predetermined higher pressure within the composite lowermost joint.

12. The combination defined in claim 11, wherein said openings are disposed in the lower end portion of the composite lowermost joint in a location which is below the blowout preventer means when the annular support member of the tubing hanger is engaged with the upwardly exposed tubing hanger support of the wellhead means.

13. In an underwater well apparatus, the combination of underwater wellhead means including upright body means defining an upright through bore, and blowout preventer means mounted on the upright body means;

handling string means capable of extending from an operational base at the surface of the water downwardly to the wellhead means and including a composite lowermost joint defining at least one larger diameter longutidinal passage, and a plurality of small longitudinal pressure fluid passages;

a handling tool comprising body means having at least one larger diameter longitudinal through passage and a plurality of small pressure fluid passages, the body having a lower end portion including a transverse annular outwardly opening groove, a tubular member surrounding the handling tool body means and coacting therewith to define an annular cylinder, a first annular piston slidably disposed in said annular cylinder and including a dependent skirt extending downwardly from said annular cylinder, a first duct in the handling tool body means communicating between a first one of the pressure fluid passages of the handling tool and said annular cylinder in a location above said first annular piston, and a second duct in the handling tool body means communicating between a second one of the pressure fluid passages of the handling tool and said annular cylinder in a location below said first annular piston;

means securing the handling tool to the lower end of the composite lowermost joint of the handling string means with the at least one larger diameter passage of the handling tool communicating with the at least one larger diameter passage of the composite lowermost joint and with the pressure fluid passages of the handling tool communicating respectively with the pressure fluid passages of the composite lowermost joint;

a well tool having a body, and a tubular sleeve projecting upwardly from the body and having a transverse annular inwardly opening groove;

the tubular sleeve of the well tool embracing the lower end portion of the body means of the handling tool and being so disposed that the inwardly opening groove of the sleeve opposes the outwardly opening groove of the lower end portion of the body means of the handling tool; and generally annular lock means disposed in one of said outwardly opening groove and said inwardly opening groove and resiliently biased for locking engagement in the others of said grooves, said lock means presenting upwardly directed cam surface means of generally frustoconical form aligned below the dependent skirt of said first annular piston and so oriented that downward movement of the piston causes the skirt to engage the cam surface means and cam the lock means to a disengaged position to disconnect the well tool from the handling tool, supply of pressure fluid via said first duct thus being effective to drive said first piston downwardly to cam the lock means to disengaged position, supply of pressure fluid via said second duct being effective to drive said first piston upwardly to disengage said skirt from the cam surface means of the lock means.

14. The combination defined in claim 13 and further comprising a second annular piston slidably disposed in said annular cylinder above said first piston; and a third duct in the handling tool body means communicating between a third one of said pressure fluid passages of the handling tool and said annular cylinder in a location above said second piston, supply of pressure fluid via said third duct being effective to drive both said second piston and said first piston downwardly to cause said dependent skirt to engage the cam surface means of the lock means.

15. The combination defined in claim 13 and further comprising annular means located in said annular cylinder above said first annular piston and fixed to the handling tool body means;

said tubular member being slidable on the handling tool body means and including an inwardly directed annular piston portion;

a fourth duct in the handling tool body means communicating between a fourth one of said pressure fluid passages of the handling tool and said annular cylinder in a location between said piston portion and said fixed annular means; and a fifth duct in the handling tool body means communicating between a fifth one of said pressure fluid passages of the handling tool and said annular cylinder in a location adjacent the upper end of said annular cylinder;

supply of pressure fluid via said fourth duct being effective to drive said tubular member upwardly, supply of pressure fluid via said fifth duct being effective to drive said tubular member downwardly.

16. The combination defined in claim 15, wherein the well tool further comprises external latch means carried by the well tool body in a location below the tubular upwardly projecting sleeve, said external latch means being resiliently biased outwardly, and a retracting sleeve for retracting said external latch means, said retracting sleeve slidably embracing said tubular upwardly projecting sleeve and being aligned below the lower end of said tubular member of the handling tool.

* * * * *